US008956062B2

(12) United States Patent
Nakayama

(10) Patent No.: US 8,956,062 B2
(45) Date of Patent: Feb. 17, 2015

(54) ROLL PAPER SUPPLY DEVICE AND PRINTING DEVICE HAVING THE SAME

(75) Inventor: Hiroyuki Nakayama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 141 days.

(21) Appl. No.: 12/963,284

(22) Filed: Dec. 8, 2010

(65) Prior Publication Data

US 2011/0170928 A1 Jul. 14, 2011

(30) Foreign Application Priority Data

Jan. 13, 2010 (JP) ..... 2010-004639

(51) Int. Cl.

| | |
|---|---|
| ***B41J 15/00*** | (2006.01) |
| ***B41J 15/04*** | (2006.01) |
| ***B65H 16/08*** | (2006.01) |
| ***B65H 23/08*** | (2006.01) |
| ***B41J 15/02*** | (2006.01) |

(52) U.S. Cl.

CPC ..... *B65H 23/08* (2013.01); *B41J 15/02* (2013.01); *B41J 15/042* (2013.01); *B65H 2801/12* (2013.01)

USPC ..... 400/611; 400/613; 400/619

(58) Field of Classification Search

USPC ..... 400/611, 613, 619; 242/564.4, 419

See application file for complete search history.

(56) References Cited

U.S. PATENT DOCUMENTS

| | | | | |
|---|---|---|---|---|
| 4,179,077 | A * | 12/1979 | Morishita | 242/423 |
| 4,359,178 | A | 11/1982 | Hayashi et al. | |
| 5,174,518 | A | 12/1992 | Hongo et al. | |
| 5,279,472 | A | 1/1994 | Hongo et al. | |
| 6,584,896 | B1 * | 7/2003 | Kashiwaba et al. | 101/93 |
| 7,069,972 | B1 | 7/2006 | Edelstein | |
| 7,284,725 | B2 | 10/2007 | Inana | |
| 7,753,606 | B2 | 7/2010 | Maekawa | |
| 7,802,750 | B2 * | 9/2010 | Takeuchi | 242/596.4 |
| 8,047,462 | B2 | 11/2011 | Yamada | |
| 2001/0006202 | A1 * | 7/2001 | Inana et al. | 242/348 |
| 2003/0015109 | A1 | 1/2003 | Glockner et al. | |
| 2005/0002721 | A1 * | 1/2005 | Koyabu | 400/613 |
| 2005/0199763 | A1 | 9/2005 | Myers et al. | |
| 2005/0232677 | A1 | 10/2005 | Ogawa et al. | |
| 2010/0247220 | A1 | 9/2010 | Maekawa | |
| 2011/0170929 | A1 | 7/2011 | Nakayama | |

FOREIGN PATENT DOCUMENTS

| | | | |
|---|---|---|---|
| CN | 101428508 | A | 5/2009 |
| JP | 384151 | U | 8/1991 |
| JP | 4-44243 | U | 4/1992 |
| JP | 562442 | U | 8/1993 |
| JP | 572851 | U | 10/1993 |
| JP | 5-95746 | U | 12/1993 |
| JP | 2000-52613 | A | 2/2000 |

(Continued)

*Primary Examiner* — Leslie J Evanisko

*Assistant Examiner* — Marissa Ferguson Samreth

(74) *Attorney, Agent, or Firm* — Lowe Hauptman & Ham, LLP

(57) ABSTRACT

A roll paper supply device has a roll paper compartment that stores roll paper with the axis of rotation transverse so that the roll paper can roll thereinside; supply rollers that feed the roll paper from the roll paper compartment in a sheet; and pair of side pressure plates that cover substantially all of the sides of the roll paper and contact part of the sides.

15 Claims, 7 Drawing Sheets

(56) References Cited

FOREIGN PATENT DOCUMENTS

| | | | |
|---|---|---|---|
| JP | 2001-118089 | A | 4/2001 |
| JP | 2002274705 | A | 9/2002 |
| JP | 2005-306535 | A | 11/2005 |
| JP | 2006-232474 | A | 9/2006 |
| JP | 2007-320107 | A | 12/2007 |
| JP | 2007-320693 | A | 12/2007 |
| JP | 2009-102129 | A | 5/2009 |

* cited by examiner

ROLL PAPER SUPPLY DEVICE AND PRINTING DEVICE HAVING THE SAME

RELATED APPLICATIONS

The present application is based on, and claim priority from, Japanese Application No. 2010-004639, filed Jan. 13,2010, the disclosure of which is hereby incorporated by reference herein in its entirety.

BACKGROUND

1. Technical Field

The present invention relates to a roll paper supply device that unrolls and supplies roll paper, and to a printing device that has the roll paper supply device.

2. Related Art

Receipt printers and other types of printers that print on roll paper are commonly used in POS (point-of-sale) systems, for example.

Japanese Unexamined Patent Appl. Pub. JP-A-2009-102129, for example, teaches a roll paper printer having a roll paper supply mechanism that, when seen from the end of the center axis of the roll paper stored in the roll paper compartment, pulls the recording paper from a position (D) on one side of a vertical line (V) passing through the center of gravity of the roll paper stored in the roll paper compartment, has supply rollers positioned on the other side of this line, and has an urging surface of an urging member positioned between this vertical (V) and the pull-off position (D) of the recording paper.

With this roll paper supply mechanism the force of pulling the recording paper, the weight of the paper roll, and the conveyance force of the supply rollers produce a moment in the direction preventing the paper roll from lifting up, and the recording paper is thus held in contact with the supply rollers.

However, with a drop-in loading type of roll paper compartment such as taught in JP-A-2009-102129, that is, a roll paper compartment in which the roll paper rests on its side in the roll paper compartment instead of being supported at the axis of rotation of the paper roll, when the outside diameter of the paper roll becomes small, the roll paper starts rolling along the urging surface and may separate from the urging surface such that stable side pressure is not applied. When this happens the paper roll may start bouncing around inside the roll paper compartment when the recording paper is pulled off and supplied to the transportation path, resulting in the roll paper not being supplied smoothly and possibly becoming skewed.

SUMMARY

A roll paper supply device and a printing device having a roll paper supply device according to the invention enables always stably delivering and supplying roll paper in a sheet.

A first aspect of the invention is a roll paper supply device including: a roll paper compartment that stores roll paper with the axis of rotation transverse so that the roll paper can roll thereinside; supply rollers that feed the roll paper from the roll paper compartment; and a side pressure plate that covers substantially all of one side of the roll paper and contacts part of a side of the roll paper.

When the roll paper is supplied in a sheet by the supply rollers in this aspect of the invention, the roll paper is pulled to the supply rollers side by the tension of the supplied roll paper. Part of one side of the roll paper contact the side pressure plate at this time, and the roll paper is held stably supported at this contact point. As a result, the roll paper can be prevented from bouncing around inside the roll paper compartment regardless of the outside diameter of the paper roll, and the roll paper can be pulled off and supplied smoothly downstream.

Further preferably in a roll paper supply device according to another aspect of the invention, the surface of the side pressure plate that contacts the side of the roll paper is inclined.

Because the surface of the side pressure plate that contacts the side of the roll paper is inclined in this aspect of the invention, the side pressure plate contacts part of the side of the roll paper, and the point of contact between the roll paper and the side pressure plate can be stably held in a fixed position.

Yet further preferably in a roll paper supply device according to another aspect of the invention, the side pressure plate is inclined toward the supply rollers approaching the side of the roll paper.

Because the side pressure plate is inclined toward the supply rollers approaching the side of the roll paper in this aspect of the invention, part of the side of the roll paper contacts the side pressure plate near the supply rollers. As a result, the roll paper can be held stably supported at the point of contact with the side pressure plate near the supply rollers.

Yet further preferably in a roll paper supply device according to another aspect of the invention, the side pressure plate is inclined down and to the side of the supply rollers approaching the side of the roll paper.

Because the side pressure plate is inclined down and to the side of the supply rollers approaching the side of the roll paper in this aspect of the invention, part of the side of the roll paper contacts the side pressure plate at the bottom of the supply rollers side. As a result, the roll paper can be held stably supported at the point of contact with the side pressure plate at the lower part of the side of the supply rollers. More particularly, up and down movement of the roll paper can be eliminated, and the sound of the roll paper dropping inside the roll paper compartment after it has moved up can be eliminated.

Yet further preferably, a roll paper supply device according to another aspect of the invention also has main feed rollers that are disposed downstream from the supply rollers and hold and convey the roll paper; a tension mechanism that is disposed to the transportation path between the supply rollers and the main feed rollers, and is supported to maintain constant roll paper tension on the main feed rollers; and sub-feed rollers that are disposed downstream from the main feed rollers and hold and convey the roll paper.

This aspect of the invention can hold the roll paper without moving vertically or sideways inside the roll paper compartment, and can therefore supply the paper without skew. In addition, by using a tension mechanism that is disposed to the transportation path between the supply rollers and the main feed rollers and is supported to maintain the tension of the roll paper on the main feed rollers constant, the paper feed speed and paper feed pitch precision can be improved. Furthermore, by having sub-feed rollers that hold and convey the roll paper on the downstream side of the main feed rollers, the roll paper can be prevented from buckling between the main feed rollers and sub-feed rollers, and paper jams can be reliably prevented.

Another aspect of the invention is a roll paper supply device including: a roll paper compartment that stores roll paper; and a supply roller that supplies the roll paper from the roll paper compartment. The roll paper compartment includes a bottom on which the roll paper rests, a first side plate that opposes a first side of the roll paper resting on the bottom and can contact this first side, and a second side plate that opposes the other side (a second side) of the roll paper resting on the bottom and can contact this second side, the first side plate and second side plate disposed so that the gap between the first side plate and second side plate across the width of the roll paper narrows in the direction in which the roll paper is pulled off.

Preferably, the roll paper is pulled upward from the bottom by the force of the supply roller; and the first side plate and second side plate contact the sides of the roll paper at the side where the gap is narrow, and hold the roll paper therebetween.

Another aspect of the invention is a printing device including the roll paper supply device described above, and a print head that prints on the supplied roll paper.

A printer according to this aspect of the invention has a roll paper supply device that can always stably supply the roll paper in a sheet, and can therefore precisely position and index the paper lengthwise to enable high quality printing.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a roll paper supply device and a printing device having the roll paper supply device according to the invention are described below with reference to the accompanying figures.

Figure 1:
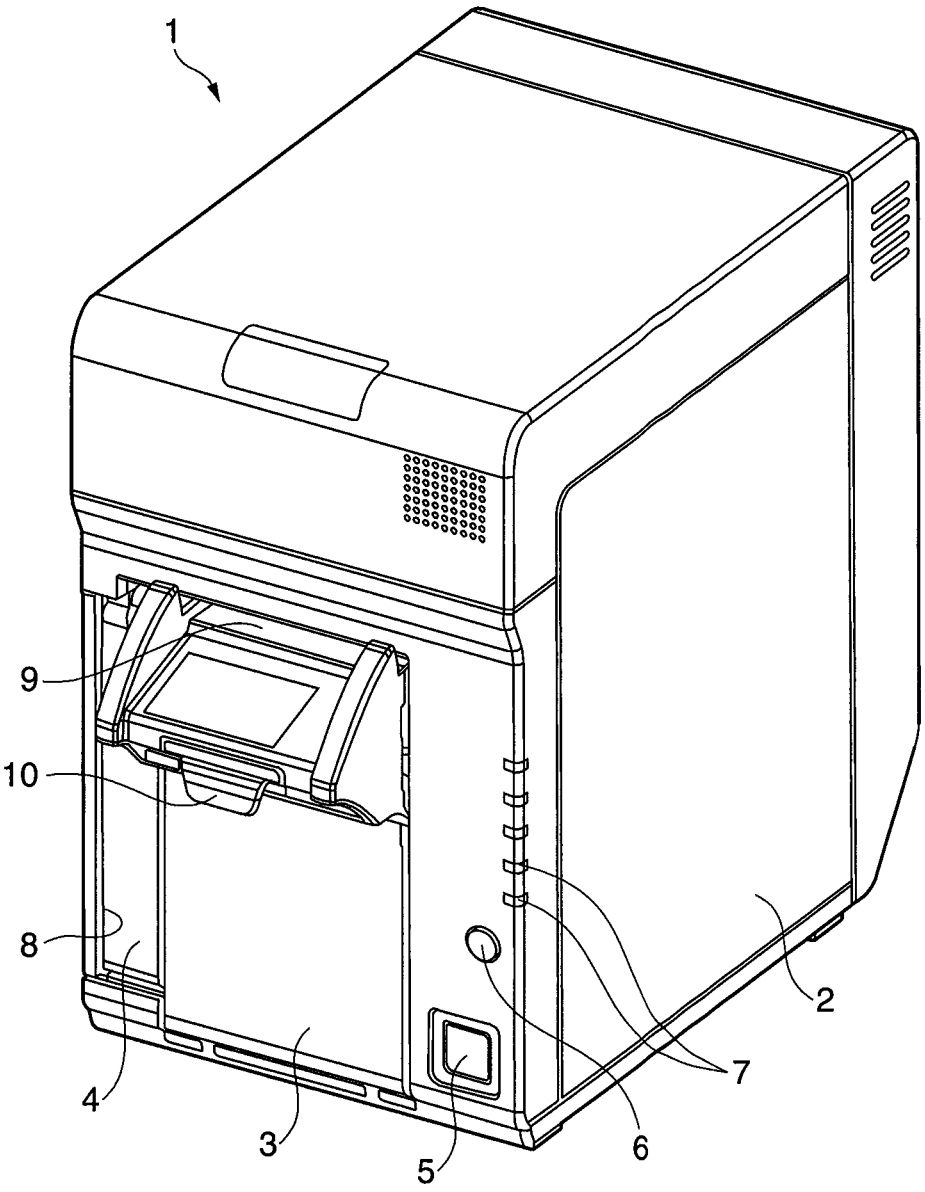
FIG. 1 is an external oblique view of an inkjet printer having a roll paper supply device according to the invention.

The inkjet printer 1 shown in FIG. 1 uses plural colors of ink to print in color on the part of the roll paper delivered from the paper roll, and has a roll paper cover (access cover) 3 disposed so that it can open and close freely in the front center part of the printer case 2 that covers the printer frame. An ink cartridge loading opening 8 is disposed on the left side of the roll paper cover 3, and an ink cartridge 4 can be inserted from this ink cartridge loading opening 8 and stored inside the printer. A power switch 5, feed switch 6, and indicators 7 are also disposed at the front of the printer case 2.

Figure 2:
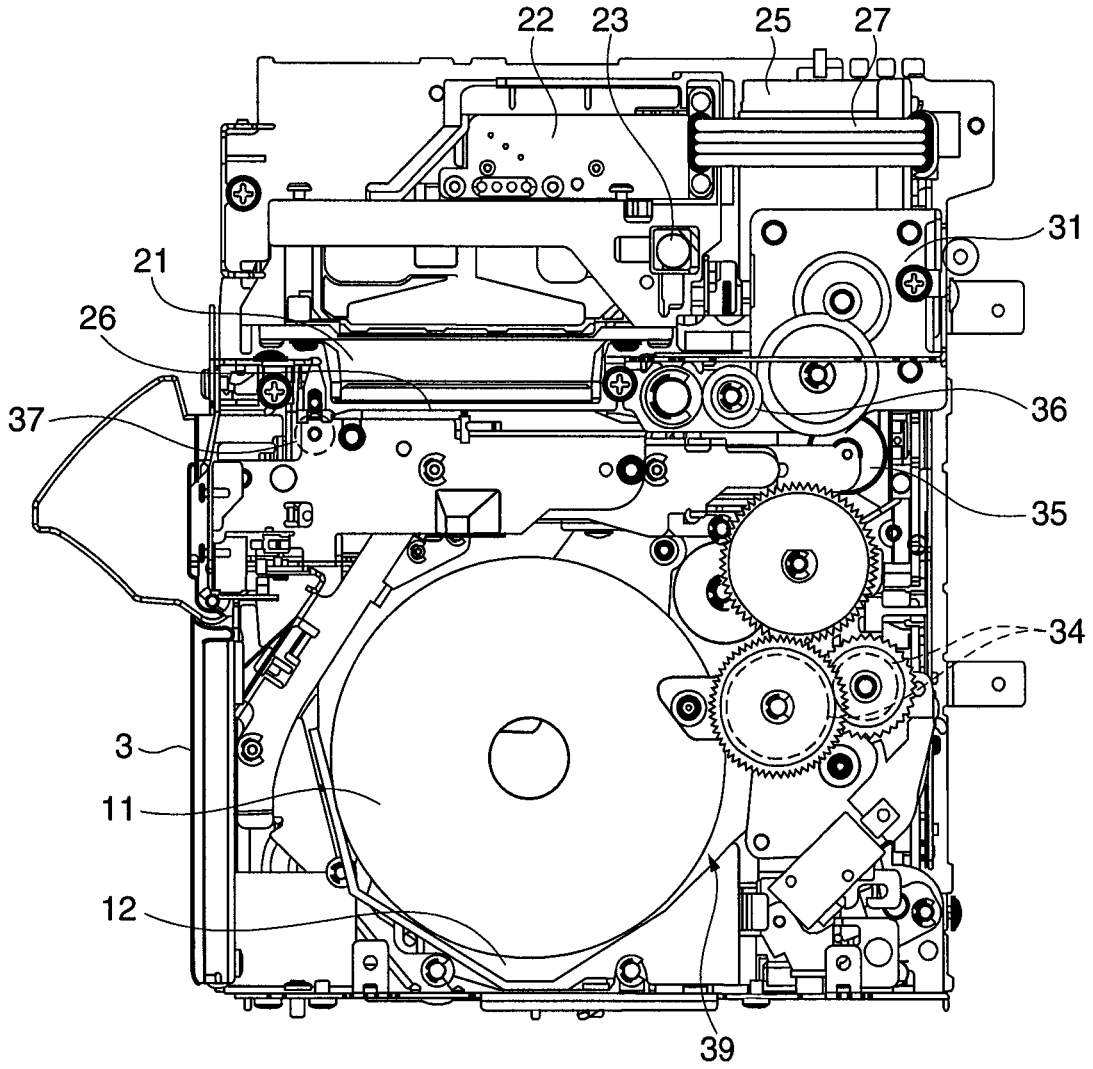
FIG. 2 is a side view of the inkjet printer with the printer case removed.

As shown in FIG. 2, the roll paper 11 used as the print medium is stored in a roll paper compartment 12. When the roll paper cover 3 is opened, the roll paper compartment 12 is open and the roll paper 11 can be loaded or replaced.

The roll paper cover 3 can roll on its bottom side. A paper exit 9 from which the roll paper is discharged after printing is rendered at the top of the roll paper cover 3, and a slider 10 that can slide to the front is disposed below the paper exit 9.

Figure 3:
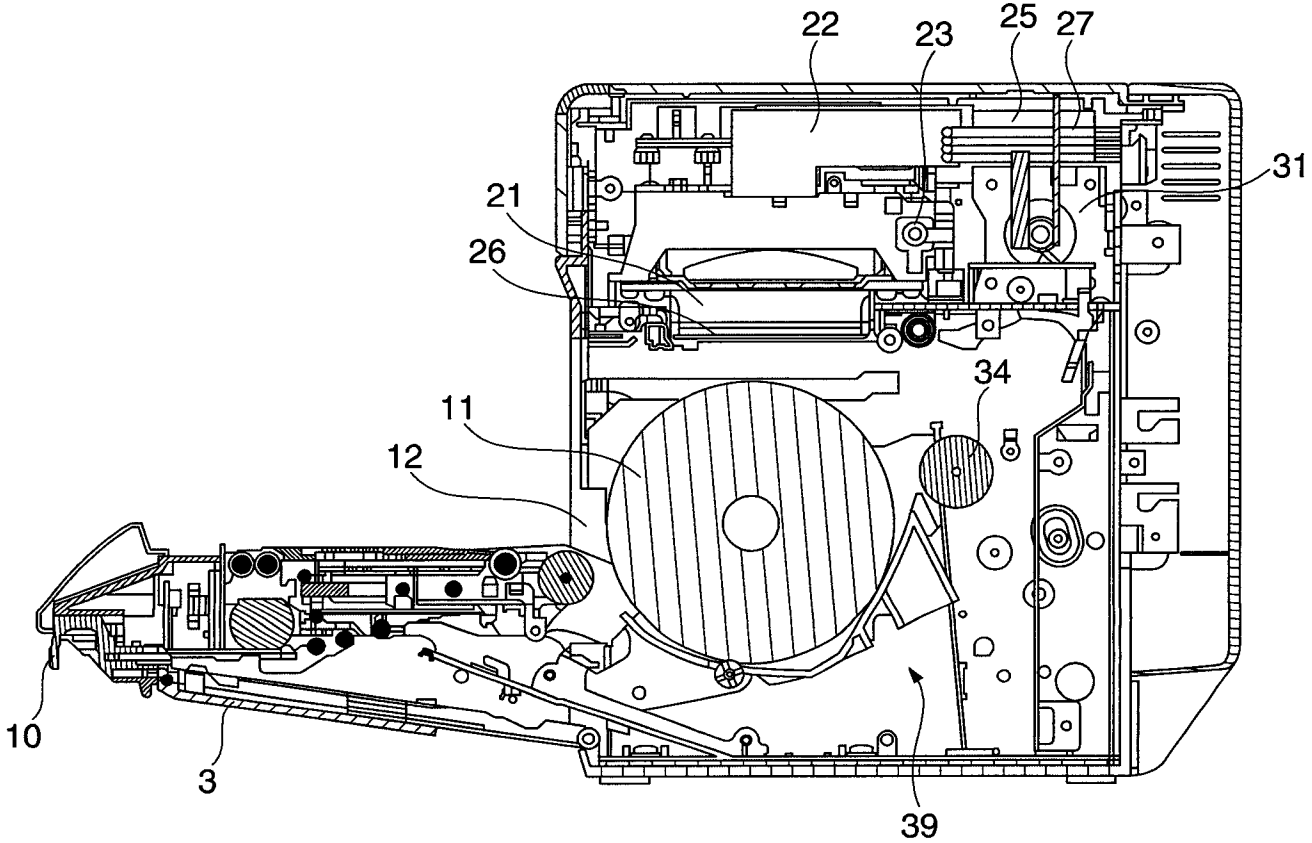
FIG. 3 is a side section view of the inkjet printer when the roll paper cover is open.

When the slider 10 is pulled forward, a lock that holds the roll paper cover 3 in the closed position is released. When the slider 10 is then pulled further forward from this position, the roll paper cover 3 pivots on its bottom end and opens as shown in FIG. 3, thereby exposing the roll paper compartment 12 rendered behind the roll paper cover 3 so that roll paper can be dropped into the roll paper compartment 12.

Figure 4:
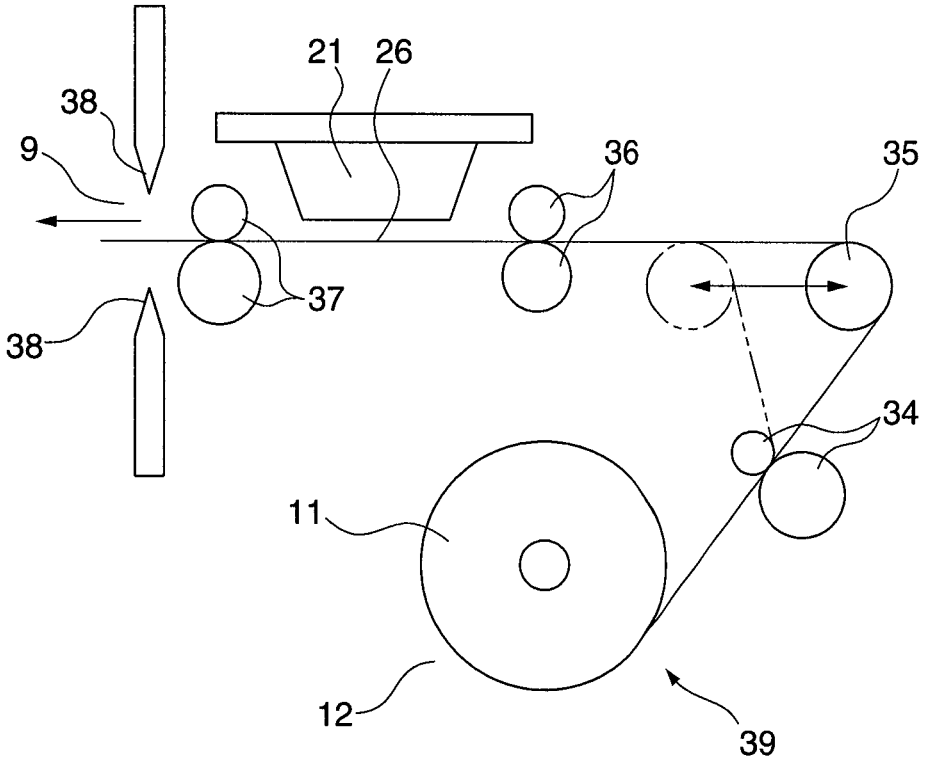
FIG. 4 is a side view schematically describing the transportation mechanism.

As shown in FIG. 4, supply rollers 34 for supplying the roll paper 11 stored in the roll paper compartment 12 in a sheet are disposed at the back top part of the roll paper compartment 12. The roll paper 11 is pulled up from the bottom 41 side. A roll paper supply device 39 is configured to pull and supply the roll paper 11 in a sheet from the roll paper compartment 12 and supply rollers 34.

Main feed rollers 36 that hold and convey the roll paper 11 therebetween are disposed on the downstream side of the supply rollers 34. A tension roller 35 (tension mechanism) that is urged to the back side of the printer by an urging member (not shown in the figure) is also disposed to the transportation path between the supply rollers 34 and main feed rollers 36 to maintain constant roll paper 11 tension on the main feed rollers 36.

Front feed rollers 37 (sub-feed rollers) that hold and convey the roll paper 11 therebetween are disposed downstream from the main feed rollers 36, and a platen 26 is disposed between the main feed rollers 36 and front feed rollers 37. A cutter 38 for cutting the printed roll paper 11 is disposed at the paper exit 9.

The roll paper 11 is pulled from the roll paper compartment 12, conveyed passed the supply rollers 34, tension roller 35, main feed rollers 36, platen 26, and front feed rollers 37, and discharged from the paper exit 9. These transportation rollers 34, 36, 37 are driven by a supply motor or paper feed motor 31 through an intervening transmission mechanism using gears or belts and pulleys, for example.

The supply rollers 34 unfurl the roll paper 11 stored in the roll paper compartment 12 into a sheet and produce paper feed power. Rotation of the main feed rollers 36 is controlled with high precision so that the main feed rollers 36 convey the roll paper 11 at a precise paper feed pitch. The tension roller 35 stabilizes the paper feed precision by maintaining a constant load on the main feed rollers 36, and enables high speed paper transportation by maintaining a constant amount of slack in the roll paper 11.

The front feed rollers 37 are a pair of cylindrical rollers, and feed the roll paper 11 sheet to the paper exit 9 while holding the roll paper 11 therebetween with sufficient clamping force. If the roll paper 11 discharged from the paper exit 9 is pulled in a direction crosswise to the discharge direction (paper feed direction), the clamping force of the front feed rollers 37 prevents the paper from being lifted away from the platen 26, prevents paper jams resulting from the paper lifting off the platen, and thereby enables printing to continue normally with good results.

As shown in FIG. 2 and FIG. 3, a carriage 22 on which an inkjet head 21 (print head) is mounted is disposed inside the printer above the roll paper compartment 12. The inkjet head 21 is mounted on the carriage 22 so that the nozzle surface in which the nozzles that discharge ink are formed faces the platen 26. The carriage 22 is supported freely movably widthwise to the paper on a guide member 23 that extends widthwise to the roll paper 11, and is connected to an endless belt (not shown in the figure). A carriage motor 25 that drives this endless belt causes the carriage 22 to travel bidirectionally widthwise to the roll paper 11 above the platen 26.

A flexible ink tube 27 that forms at least part of the ink path that communicates with the ink cartridge is connected to the carriage 22. Ink is supplied through this ink tube 27 from the ink cartridge 4 stored in the ink cartridge storage unit to the inkjet head 21 carried on the carriage 22.

The standby position (home position) of the bidirectionally moving carriage 22 is on one side of the inkjet printer 1. An ink suction mechanism (not shown in the figure) that suctions ink from the nozzles of the inkjet head 21 exposed below the carriage 22 is rendered below this standby position.

The inkjet printer 1 thus prints by discharging ink from the inkjet head 21 mounted on the bidirectionally travelling carriage 22 onto the portion of roll paper 11 delivered from the paper roll.

The structure of the roll paper supply device 39 is described next with reference to FIG. 5 to FIG. 7.

As described above, the roll paper supply device 39 includes the roll paper compartment 12 and supply rollers 34. The roll paper compartment 12 includes a roll paper holder 40, and the roll paper holder 40 has a plastic bottom 41 that is curved when seen from the side, and a metal side pressure plate 42 (first side plate) that is connected to one side of the bottom 41. The roll paper 11 is placed on the bottom 41, and is stored in the roll paper compartment 12 so that it can roll with its axis of rotation extending transversely, that is, parallel to the rotational axis of the supply rollers 34.

The roll paper compartment 12 also has a metal side pressure plate 43 (second side plate) that is attached to the inside of the right side frame (not shown in the figure) of the inkjet printer 1 in opposition to the side pressure plate 42 of the roll paper holder 40. As a result, the roll paper 11 resting on the bottom 41 is disposed between side pressure plate 42 and side pressure plate 43 with all of one side (end) covered by side pressure plate 42 and all of the other side (end) covered by side pressure plate 43. Both side pressure plate 42 and side pressure plate 43 are touching the sides (ends) of the roll paper 11 (paper roll).

Figure 6:
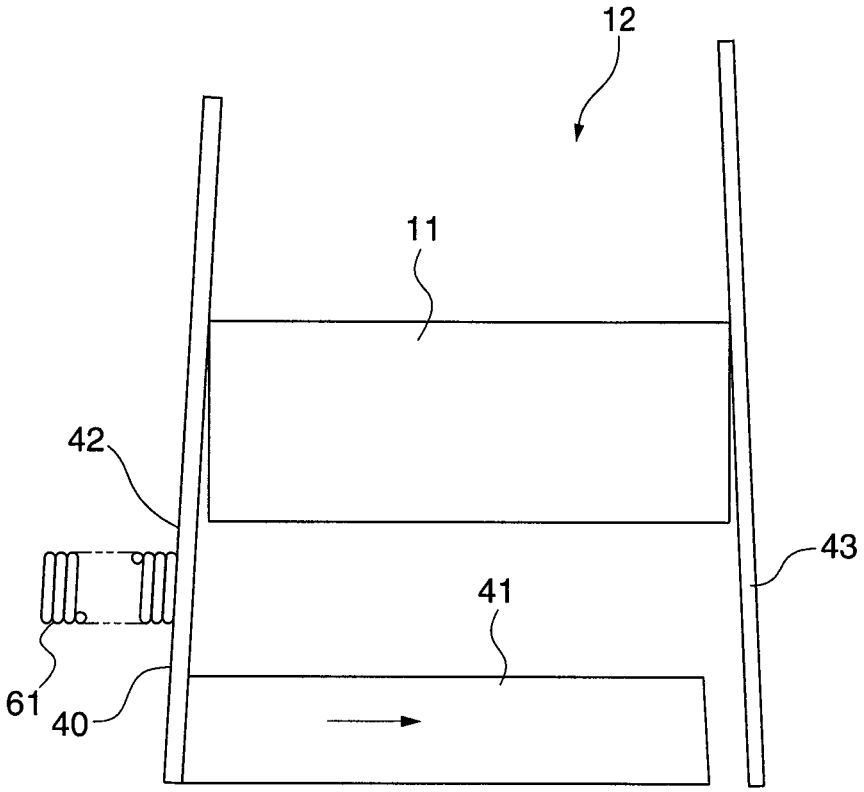
FIG. 6 is a schematic section view of the roll paper supply device as seen from the front of the inkjet printer.

As shown in FIG. 6, the side pressure plates 42 and 43 are inclined to the side ends of the roll paper 11 stored in the roll paper compartment 12. More specifically, the side pressure plates 42 and 43 are inclined so that they become closer to the sides of the roll paper 11 with proximity to the supply rollers 34 that are disposed in the roll paper compartment 12 at the back top part of the inkjet printer 1. In other words, side pressure plate 42 and side pressure plate 43 are disposed so that the gap between side pressure plate 42 and side pressure plate 43 narrows in the direction in which the roll paper 11 is pulled off the roll. More specifically, the side pressure plate 42 and side pressure plate 43 are disposed so that the gap therebetween on the downstream side becomes narrower than the gap on the upstream side with respect to both the horizontal component and the vertical component of the direction in which the roll paper 11 is delivered from the paper roll. Note that the slope of the side pressure plates 42 and 43 is greater than or equal to the dimensional error and deflection.

Figure 5:
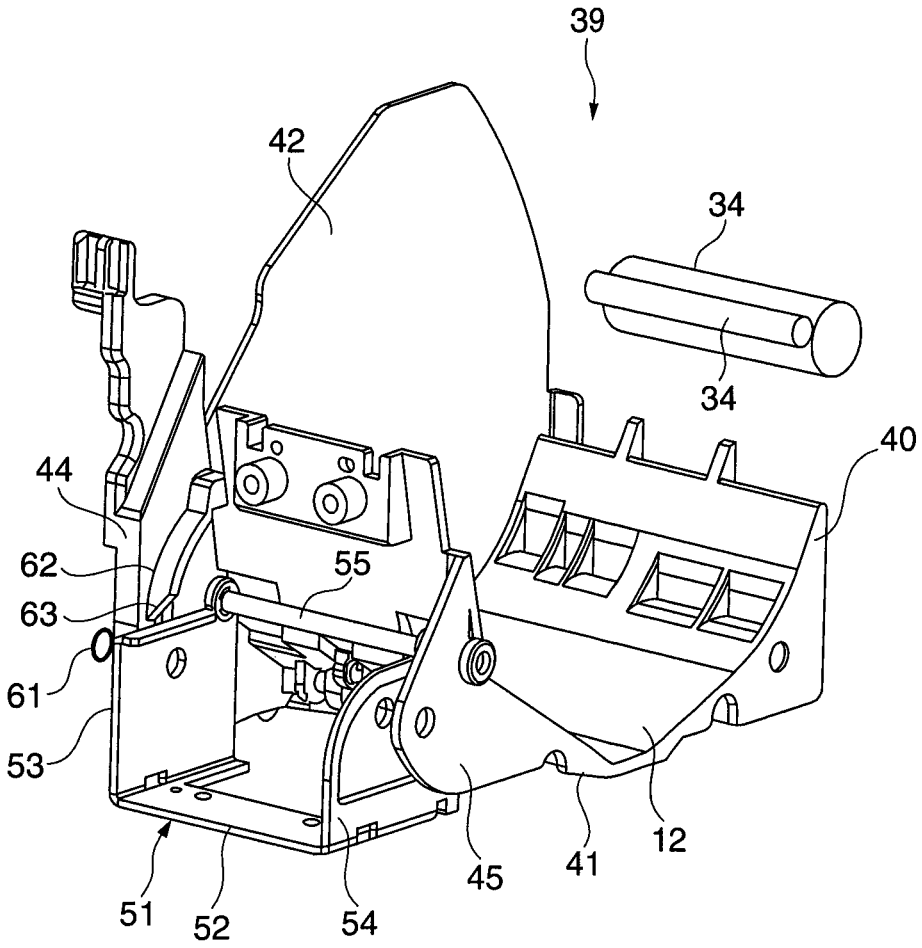
FIG. 5 is an oblique view of the roll paper supply device.

As shown in FIG. 5, connection panels 44, 45 that extend from the opposite sides of the bottom 41 toward the front of the inkjet printer 1 (the opposite side as the side where the roll paper 11 is positioned) are also disposed to the roll paper holder 40. A support bracket (support unit) 51 is disposed at the front of the roll paper holder 40 (in the space between the roll paper holder 40 and roll paper cover 3). This support bracket 51 includes a stationary panel 52 that is fastened to the bottom frame (not shown in the figure) of the inkjet printer 1, and support panels 53 and 54 disposed substantially perpendicularly to the opposite sides of the stationary panel 52. A support shaft 55 spans widthwise to the roll paper 11 (in line with the rotational axis) between the support panels 53 and 54.

The connection panels 44, 45 of the roll paper holder 40 are supported by the support shaft 55, thereby enabling the roll paper holder 40 to pivot on the support points of the support shaft 55.

When the slider 10 is pulled forward and the roll paper cover 3 is opened, the roll paper holder 40 rotates with the roll paper cover 3 to the front of the inkjet printer 1, exposing the roll paper compartment 12.

The roll paper holder 40 is urged sideways (in the direction of the support shaft 55) by a compression spring 61 (urging member) disposed outside the side pressure plate 42, and the inside surface of the connection panel 44 on the side pressure plate 42 side thus contacts the outside surface of the support panel 53 of the support bracket 51.

More specifically, the compression spring 61 is disposed between the connection panel 44 and the left-side frame (not shown in the figure) of the inkjet printer 1 located on the outside side of the connection panel 44, and urges the connection panel 44 transversely. As a result, the bottom 41 to which the connection panel 44 is disposed and the side pressure plate 42 connected to the bottom 41 are urged toward the other side pressure plate 43 side.

A side pressure release cam 62 (protrusion) that protrudes to the inside (to the connection panel 45 side) is rendered on the connection panel 44 on the side pressure plate 42 side of the roll paper holder 40. This side pressure release cam 62 is formed in an arc centered on the support shaft 55, and is positioned above the support panel 53 when the roll paper holder 40 is closed (in a first position). A tapered part 63 is formed on one end of the side pressure release cam 62, that is, the end in the direction of rotation from the closed position of the roll paper holder 40 to the open position (second position). The width of the tapered part 63 increases with distance from the distal end thereof. The side pressure release cam 62 protrudes a constant width except at this tapered part 63.

When the roll paper holder 40 with this side pressure release cam 62 rotates on the support shaft 55 to the front of the inkjet printer 1 as a result of opening the roll paper cover 3, the tapered part 63 of the side pressure release cam 62 contacts and gradually displaces the support panel 53 of the support bracket 51 in resistance to the urging force of the compression spring 61. More specifically, the side pressure plate 42 of the roll paper holder 40 is displaced along the support shaft 55 in the direction away from the side pressure plate 43.

When contact between the side pressure release cam 62 and the support panel 53 moves passed the tapered part 63 and reaches the part where the protrusion width is constant, the roll paper holder 40 rotates while the gap between the side pressure plates 42 and 43 is held increased by the protrusion width of the side pressure release cam 62. Because the side pressure plate 42 is thus displaced so that the gap between side pressure plate 42 and side pressure plate 43 is greater than the width of the roll paper 11 loaded therebetween when the roll paper cover 3 is opened, the roll paper 11 can be easily and smoothly removed from and dropped into the roll paper compartment 12.

When the roll paper cover 3 is closed, the roll paper holder 40 rotates on the support shaft 55 to the back of the inkjet printer 1, and when the contact between the side pressure release cam 62 and support panel 53 reaches the tapered part 63, the roll paper holder 40 urged by the compression spring 61 is displaced along the slope of the tapered part 63. More specifically, the side pressure plate 42 of the roll paper holder 40 is gradually displaced in the direction approaching the side pressure plate 43.

When the side pressure release cam 62 then separates from the support panel 53, the roll paper holder 40 is disposed with side pressure plate 42 inclined toward side pressure plate 43. As a result, when the roll paper cover 3 is closed, the gap between the side pressure plate 42 and side pressure plate 43 narrows, and the roll paper 11 dropped into the roll paper compartment 12 is held easily and smoothly.

Figure 7:
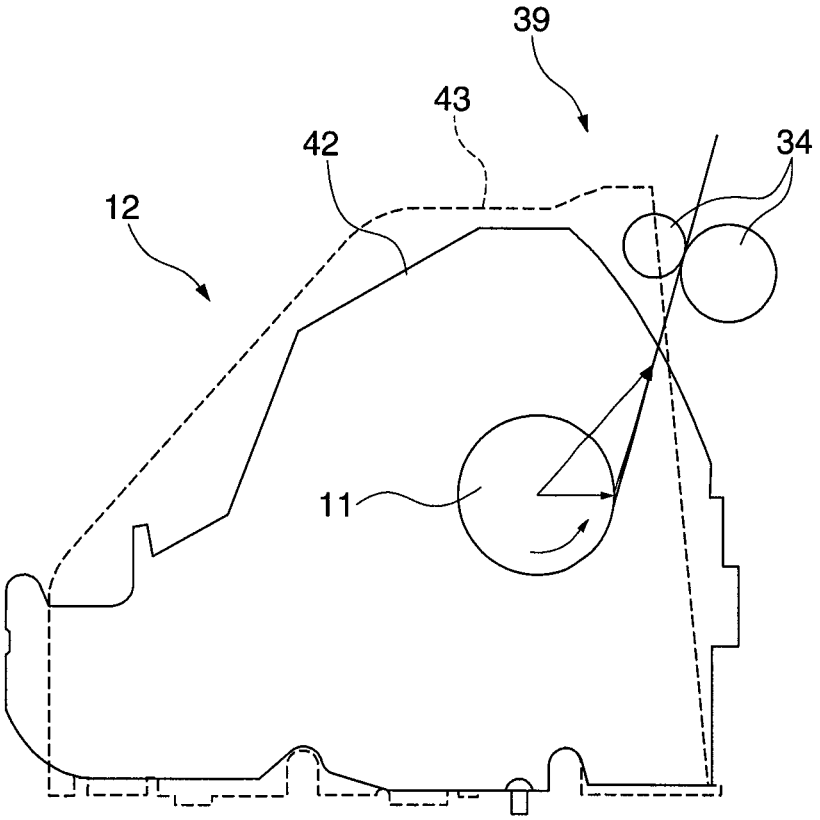
FIG. 7 is a schematic side view of the roll paper supply device describing the behavior of the roll paper in the roll paper compartment.

As shown in FIG. 7, when the roll paper 11 is supplied in a sheet by the supply rollers 34, the roll paper 11 is pulled to the supply roller 34 side by the tension on the roll paper 11 being supplied. Because the side pressure plates 42 and 43 are inclined towards the supply rollers 34 so that they approach the sides of the roll paper 11 at this time, the roll paper 11 contacts the side pressure plates 42 and 43 on both sides at the supply rollers 34 side, and the roll paper 11 is thus held stably supported at a position near the supply rollers 34. The pressure of the side pressure plates 42 and 43 on the end faces of the paper roll of the roll paper 11 is greater at the edge on the outfeed side of the roll than at other parts of the side.

As the roll paper 11 is printed and consumed, the diameter of the roll gradually decreases, but even when the diameter is small, the roll paper 11 is held stably supported by the side pressure plates 42 and 43 at a position near the supply rollers 34.

In addition, when small diameter paper roll 11 is dropped into the roll paper compartment 12 and rests on the bottom 41 of the roll paper holder 40, and the roll paper 11 is supplied in a sheet by the supply rollers 34 in conjunction with printing, the roll paper 11 will be lifted toward the supply rollers 34 and the sides of the paper will contact the side pressure plates 42 and 43 at the supply roller 34 side. As a result, the roll paper 11 is held stably supported at a position near the supply rollers 34 as the paper is pulled off the roll and the roll diameter decreases with printing.

When the roll paper 11 is supplied in a sheet by the supply rollers 34 in the roll paper supply device 39 according to this embodiment of the invention, part of both sides of the roll paper 11 contact the side pressure plates 42 and 43, and the roll paper 11 is held stably supported at these contact points. As a result, the roll paper 11 can be prevented from bouncing around inside the roll paper compartment 12, and the roll paper 11 can be smoothly pulled off and supplied downstream regardless of the size of the outside diameter of the roll paper 11.

Furthermore, because the inkjet printer 1 according to this embodiment of the invention has a roll paper supply device 39 that can always stably supply the roll paper 11 in a sheet, the paper can be precisely positioned and indexed lengthwise to enable high quality printing.

Furthermore, because the printer has a roll paper compartment 12 that can hold the roll paper 11 so that it does not move up and down or sideways, and a transportation mechanism including supply rollers 34, a tension roller 35, main feed rollers 36, and front feed rollers 37 that convey the roll paper 11 stored in the roll paper compartment 12, paper can be conveyed without skewing, the paper feed speed can be improved, paper feed pitch precision can be improved, the paper can be prevented from lifting off the platen 26, and excellent resistance to paper jams can be achieved.

In this embodiment of the invention the side pressure plates 42 and 43 are inclined toward the supply rollers 34, which are disposed to the roll paper compartment 12 at the back top part of the inkjet printer 1, so that the side pressure plates 42 and 43 approach the sides of the roll paper 11, but the side pressure plates 42 and 43 may be inclined downward to the sides of the supply rollers 34 approaching the sides of the roll paper 11.

With this configuration the roll paper 11 can also be held towards the bottom of the roll paper compartment 12 when the roll paper 11 is pulled off in a sheet. Up and down movement of the roll paper 11 can thus be eliminated, and the noise of the roll paper 11 dropping inside the roll paper compartment 12 after it is lifted up can be eliminated.

Note, further, that while both side pressure plates 42 and 43 are inclined in the foregoing embodiment, a configuration in which only one is inclined is also conceivable. For example, a configuration in which only the side pressure plate 42 is inclined to the side of the roll paper 11 is conceivable.

In addition, the side pressure release cam 62 may be rendered with a constant protrusion width, and a tapered part may be rendered on the support panel 53 side. Alternatively, a tapered part may be rendered on both the side pressure release cam 62 and the support panel 53.

The medium used as a print medium in the foregoing embodiment is not specifically limited and may also include film, cloth, and metal foil.

The inkjet printer according to the foregoing embodiment of the invention may also be rendered with some of the functions or mechanisms of a computer, a CRT or other display device, input devices, a floppy disk drive, or a CD-ROM drive, for example. For example, the printer may be configured with an image processing unit for image processing, a display unit for displaying information, and a recording medium drive for using recording media storing image data captured by a digital camera, for example.

A computer system including the printer according to the invention, a computer, a CRT or other display unit, a mouse, keyboard, or other input device, a floppy disk drive, and a CD-ROM drive will also be a system that is superior to conventional computer systems.

A color inkjet printer is used as the printer in the foregoing embodiments, but the invention is not so limited and can be applied to any printing device that can print on roll paper, including monochrome inkjet printers, laser printers, thermal printers, and facsimile machines.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A roll paper supply device, comprising:

a roll paper compartment that stores therein roll paper with a transverse axis of rotation so that the roll paper is rotatable inside the roll paper compartment, the roll paper compartment comprising:

a roll paper holder having a first side plate that covers substantially an entirety of one side of the roll paper, the first side plate having a surface that contacts a part of the one side of the roll paper, and a bottom plate on which the roll paper is placed, and a second side plate attached to a frame;

an urging member that urges the roll paper holder, including the bottom plate, toward the second side plate; and supply rollers configured to feed a sheet pulled off the roll paper along a transportation path and downstream in a feeding direction;

wherein the surface of the first side plate that contacts the one side of the roll paper is inclined such that the first and second side plates converge toward each other so that a gap formed between the first and second side plates on a downstream side is narrower than a gap formed between the first and second side plates on an upstream side with respect to both a horizontal component and vertical component of the feeding direction in which the sheet is pulled off the roll paper by the supply rollers.

2. The roll paper supply device described in claim 1, further comprising:

main feed rollers that are disposed downstream from the supply rollers and configured to hold and convey the sheet from the roll paper;

a tension mechanism that is disposed to the transportation path between the supply rollers and the main feed rollers, and is supported to maintain constant roll paper tension on the main feed rollers; and sub-feed rollers that are disposed downstream from the main feed rollers and configured to hold and convey the sheet from the roll paper.

3. The roll paper supply device described in claim 1, wherein:

the roll paper is arranged to be pulled upward from the bottom plate by a force of the supply rollers; and the first side plate and second side plate are configured to contact the sides of the pulled up roll paper where the gap between the first side plate and second side plate across a width of the roll paper is narrow, and to hold the roll paper therebetween.

4. The roll paper supply device described in claim 1, wherein the first side plate directly contacts an uppermost part of the one side of the roll paper.

5. The roll paper supply device described in claim 4, wherein the first side plate is free of direct contact with a lower part of the one side of the roll paper, the lower part below a central axis of the roll paper.

6. The roll paper supply device described in claim 5, wherein the first side plate has a uniform thickness along the inclined surface.

7. The roll paper supply device described in claim 1, wherein the first side plate is free of direct contact with a lower part of the one side of the roll paper, the lower part below a central axis of the roll paper.

8. The roll paper supply device described in claim 7, wherein the first side plate has a uniform thickness along the inclined surface.

9. The roll paper supply device described in claim 1, wherein the first side plate has a uniform thickness along the inclined surface.

10. The roll paper supply device described in claim 1, wherein the urging member includes a spring that urges the roll paper holder toward the second side plate.

11. A printing device, comprising:

a roll paper compartment that stores therein roll paper with a transverse axis of rotation so that the roll paper is rotatable inside the roll paper compartment, the roll paper compartment comprising:

a roll paper holder having a first side plate that covers substantially an entirety of one side of the roll paper, the first side plate having a surface that contacts a part of the one side of the roll paper, and a bottom plate on which the roll paper is placed, and a second side plate attached to a frame;

an urging member that urges the roll paper holder, including the bottom plate, toward the second side plate;

supply rollers configured to feed a sheet pulled off the roll paper along a transportation path and downstream in a feeding direction; and a print head configured to print on the sheet supplied from the roll paper, wherein the surface of the first side plate that contacts the one side of the roll paper is inclined such that the first and second side plates converge toward each other so that a gap formed between the first and second side plates on a downstream side is narrower than a gap formed between the first and second side plates on an upstream side with respect to both a horizontal component and vertical component of the feeding direction in which the sheet is pulled off the roll paper by the supply rollers.

12. A roll paper supply device, comprising:

a roll paper compartment that stores therein roll paper with a transverse axis of rotation so that the roll paper is rotatable inside the roll paper compartment, the roll paper compartment comprising:

a roll paper holder having a first side plate that covers substantially an entirety of one side of the roll paper, the first side plate having a surface that contacts a part of the one side of the roll paper, and a bottom plate on which the roll paper is placed, and a second side plate attached to a frame;

an urging member that urges the roll paper holder toward the second side plate; and supply rollers configured to feed a sheet pulled off the roll paper along a transportation path and downstream in a feeding direction;

wherein the surface of the first side plate that contacts the one side of the roll paper is inclined such that the first and second side plates converge toward each other so that a gap formed between the first and second side plates on a downstream side is narrower than a gap formed between the first and second side plates on an upstream side with respect to both a horizontal component and vertical component of the feeding direction in which the sheet is pulled off the roll paper by the supply rollers;

the roll paper supply device further comprising:

a roll paper cover rotatable between a closed position where the roll paper cover closes the roll paper compartment, and an opened position where the roll paper cover opens the roll paper compartment; and a side plate release mechanism configured to move the first and second side plates away from each other in response to a rotation of the roll paper cover from the closed position to the opened position.

13. The roll paper supply device described in claim 12, wherein the side plate release mechanism includes a cam.

14. The roll paper supply device described in claim 13, wherein the cam has a width varying along a rotational direction of the roll paper cover.

15. The roll paper supply device described in claim 14, wherein the cam is curved along the rotational direction of the roll paper cover.

* * * * *